United States Patent [19]

Gabourie

[11] 4,035,019

[45] July 12, 1977

[54] ARMCHAIRS HAVING TUBULAR FRAMES

[76] Inventor: Gregory Gabourie, 30 Hills Road, Ajax, Ontario, Canada

[21] Appl. No.: 654,945

[22] Filed: Feb. 3, 1976

[51] Int. Cl.[2] ..... A47C 3/04

[52] U.S. Cl. .....297/239; 297/418; 297/419; 297/447; 297/448

[58] Field of Search ..... 297/239, 418–420, 297/445–447

[56] References Cited

FOREIGN PATENT DOCUMENTS 1,324,755 3/1963 France ..... 297/239

*Primary Examiner*—James C. Mitchell

[57] ABSTRACT

An armchair is provided in which a central tubular frame member co-operates with two flanking tubular frame members so that portions of the central tubular member are joined to portions of the flanking tubular members to form armrests in the form of closed quadrilateral loops. Each armrest has a top rail which is formed by welded together parallel horizontal portions of the central and flanking members, and a front rail formed by vertical portions of these two members which are offset relative to one another so as to provide means to locate the front legs of a further chair stacked on top of the first chair with the bottom rail of its armrest resting on the top rail of the armrest of the first chair. The chair may have integral legs formed by portions of the frame members, or may be adapted for mounting on a swivel base.

8 Claims, 3 Drawing Figures

ARMCHAIRS HAVING TUBULAR FRAMES

FIELD OF THE INVENTION

This invention relates to arm chairs of the type having tubular metal frames.

REVIEW OF THE PRIOR ART

In recent years, a very large number of designs for tubular framed chairs have been evolved, and tend to fall broadly into three groups.

Firstly there are chairs in which there is an integral sealing unit which is substantially rigid, the tubular frame being intended merely to provide a suitable stand for the seating unit.

Secondly, there have been designs in which the body supporting surfaces of the chair (the seat, backrest and armrests) are supported on a framework of relatively small diameter tubing. Such frameworks are generally relatively complex and made up of a number of pieces of tube welded or otherwise secured together at a considerable number of locations. Quite apart from the expense of fabrication, the large number of joints all provide possibilities for failure of the chair in service. Sometimes such chairs are required to be stackable and in such cases it has been difficult to evolve designs which are not clumsy and awkward in appearance.

Thirdly, there have been designs utilizing large diameter tubing which, because of its strength and rigidity allows much simplified frame designs. However, such tubing is expensive, the designs tend to be rather too advanced for all tastes and they are not generally suitable for example for office and contract furnishing.

SUMMARY OF THE INVENTION

The present invention seeks to provide an armchair of the second category mentioned above which has a frame of simple design, which is strong and rigid, which minimizes the number of joints required between tubes, which is of excellent appearance without being unduly unconventional, and which can be made in readily stackable forms.

According to the invention, an armchair comprises a seat, a backrest, and a tubular frame supporting the seat and backrest and forming armrests flanking the seat, wherein the tubular frame is formed by three continuous lengths of tube forming a central frame member and two flanking frame members respectively, the central frame member having a connecting portion providing a frame supporting the backrest and two outer portions in substantially vertical front and rear extending planes, which planes are parallel and adjacent to planes occupied by the flanking members, wherein the tops of the armrests are formed by welded-together parallel and substantially horizontal adjacent portions of said central and flanking frame members, the fronts of said arm rests are formed by downturned continuations of said parallel portions, and said seat is supported by side rails formed by further retroverted continuations of at least one of said downturned continuations on each side of the chair, said side rails being supported at their rear ends from downturned rear continuations of the flanking members from the rear of said parallel portions forming the tops of the armrests.

Apart from any cross members provided beneath the set and extending between the seat side rails, this construction need necessitate no more than three connections between frame members on each side of the chair, formed between the parallel portions forming the top and front of the arm rests and between the side seat rails and the rear continuations of the flanking members. The structure is nevertheless of great strength and rigidity since the horizontal parallel portions may be welded together along their length, minimizing the possibility of any failure, and the other connections support one another and contribute to combined arm rest and seat rail structures of great rigidity and strength which form the foundation of the seat frame. Since there is no lateral overlap between the central and flanking members, the chair is readily designed for stacking, and location of the chairs when stacked may readily be achieved by causing the forward projection of the downturned portions of the frame members forming the fronts of the armrests to differ as between the central and flanking frame members.

The chair may be provided with a rigid leg structure merely by continuing downwardly the downturned portions at the rear of the armrest and those downturned portions at the front of the armrest which do not form the side seat rails. Alternatively, the chair may be mounted on any desired stand or base, for example a swivel base or a supporting column or bracket secured beneath the seat.

SHORT DESCRIPTION OF THE DRAWINGS

Preferred embodiments of the invention are described further below with reference to the accompanying drawings, in which.

DESCRIPTION OF THE PREFERRED EMBODIMENTS

Figures 1, 2, 3:
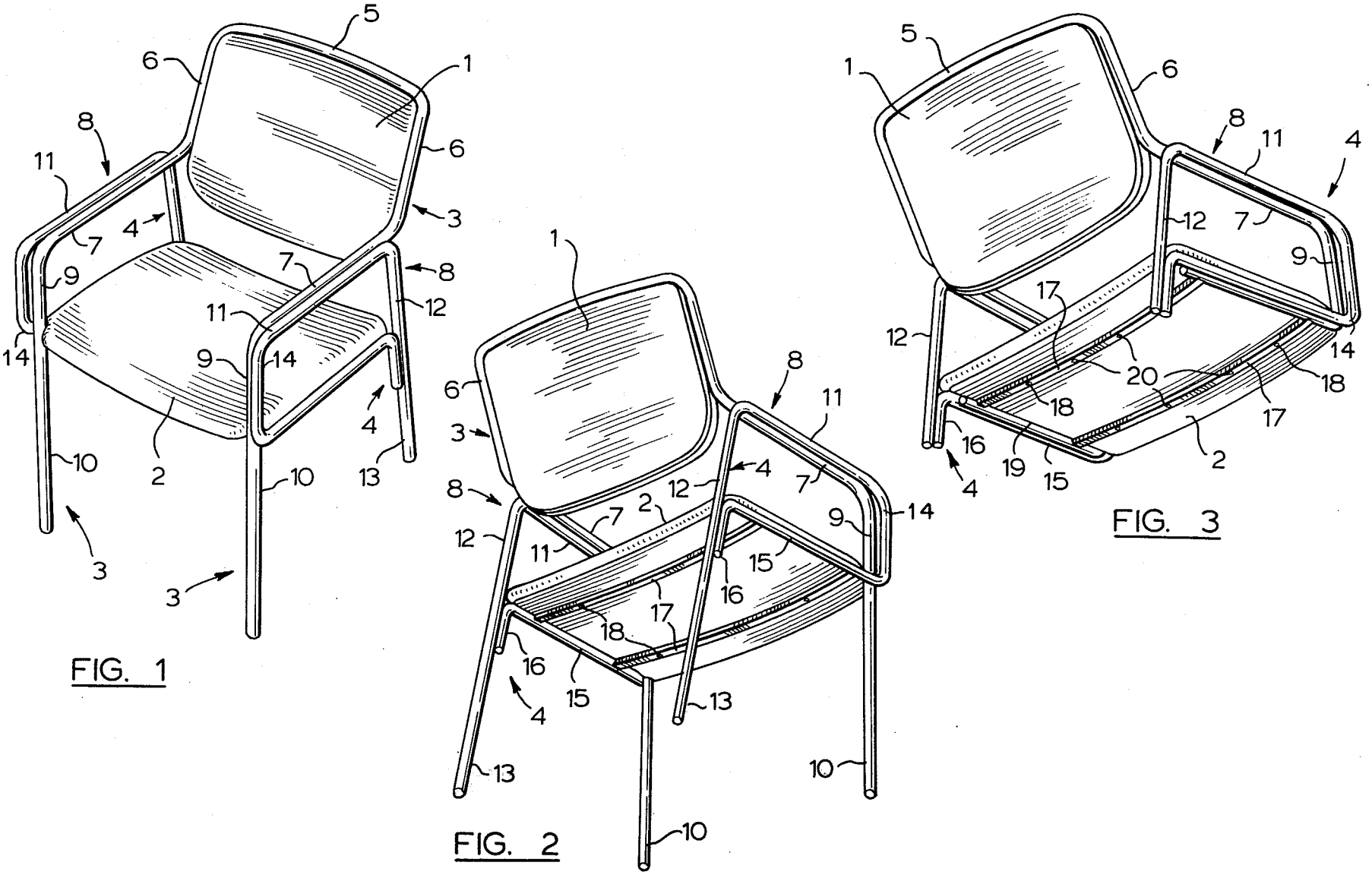
FIG. 1 is a perspective view of a chair from above, the front and one side.
FIG. 2 is a perspective view of the same chair from below, the rear and the other side.
FIG. 3 is a view corresponding to FIG. 2, but of a second embodiment of chair.

Referring first to FIGS. 1 and 2, an armchair comprises as its principal components a backrest 1, a seat 2, a central tubular frame member 3, and two flanking tubular frame members 4.

The central frame member extends transversely to form a top rail 5 above the backrest 1, thence downwardly at either end to form side rails 6 to either side of the backrest. The backrest is secured to the frame member 3 by means of lugs (not shown) welded to the latter.

From the lower ends of the backrest side rails the two sides of the central frame member extend forwards and substantially horizontally to form inner parts 7 of the tops of armrests 8, and thence downwardly to form firstly inner parts 9 of the fronts of the armrests 8, and finally front legs 10 of the chair.

The flanking frame members 4 extend to front and rear in planes which are adjacent and parallel to the planes occupied on each side of the chair by the parts 7, 9 and 10 of the central frame member 3. They have horizontally extending portions which form outer parts 11 of the tops of the armrests 8, these parts extending parallel and being welded to the parts 7 along their length. At the rear of the parts 11, the members 4 extend downwardly, firstly provides part 12 forming the backs of the armrests and then the rear legs 13 of the chair. At the front of the parts 11, the members 4 also extend downwardly to form outer parts 14 of the front of the armrests parallel to but somewhat forward of the portions 9. Thence the members extend substantially horizontally and rearwardly to form side rails 15 flanking the seat 2, and finally they are turned downwardly to provide portions 16 which are welded to the rear legs 13 so as to support the seat rails at their rear ends from the rear of the armrests. The seat rails are additionally supported at their front end by being welded to the central member 3 where they intersect the latter. The seat is supported from the seat rails by cross members 17 which extend beneath the seat 2 between the seat rails, and to which the seat is attached by means of screws 18.

It will be seen that the members 3 and 4 cooperate to provide, on each side of the chair, quadrilateral armrest structures of great strength and rigidity, formed by the portions 8 and 9 of the central tubular frame member 3 and the portions 11, 12, 14 and 15 of the flanking members 4. Each armrest involves just three welds, each weld of the three serving to support the others and thus increase the rigidity of the assembly and reduce the risk of failure, whilst the armrest also forms a rigid foundation for the remainder of the frame structure, which involves no further welds other than those required to apply the cross members 17 and the lugs used to secure the backrest. If the backrest and seat were screwed or otherwise secured directly to the parts 6 and 16, then even these additional welds could be dispensed with.

The chair just described can be stacked with other similar chairs, in which case the seat side rails 16 of a superposed chair rest on the inner arm rest portions 7 of the chair beneath. The chairs are located against relative sideways movement, at the rear by interaction between the legs 13 of the upper chair and the backrest side rails 6 of the lower chair, and at the front by engagement between the legs 10 and the forwardly projecting armrest portions 14.

The design of the chair can readily be modified for applications in which it is desired to mount it on a separate base or stand rather than using integral legs. Such a modified design is shown in FIG. 3, the same reference numerals being used to denote parts corresponding to those already described above with reference to FIGS. 1 and 2. Since the design of the base or stand is a matter of choice, no such base or stand is shown, but it may be secured to the cross-member 17 beneath the seat by means of bolts passed through holes 20 in the cross-members. The chair is generally similar to that of FIGS. 1 and 2 except that the rear legs 13 are absent below the level of their juncture with the parts 16, and the front legs 10 of the chair are replaced by end portions of the central frame member which extend substantially horizontally rearwardly within and parallel to the seat side rails 15 so as to form inner seat side rails 19. The cross-members 17 are secured to the rails 19 instead of the rails 15, although the rails 15 and 19 are welded together at front and rear so that support of the seat side rails by the front and rear members of the armrests is maintained.

What I claim is:

1. An armchair comprising a seat, a backrest, and a tubular frame supporting the seat and backrest and defining armrests, wherein the frame comprises a central tubular frame member and two flanking tubular frame members each formed from a single length of tubing, a centre portion of the central frame member defining a backrest frame surrounding the top and sides of the backrest, and each end portion of the central frame member extending in an adjacent fore and aft vertical plane with one of the flanking members so as to define therewith an armrest in the form of a closed quadrilateral loop in which a top rail of the armrest is formed by parallel substantially horizontal portions of said central and flanking members welded together, in which a front rail is formed by portions of said central and flanking members, and in which the bottom rail of the armrest includes a portion of one of the tubular members forming a seat side rail from which the seat is supported, the seat side rail being supported at front and rear by welds formed between the side rail and adjacent tubular frame member portions, and wherein the portions of the central and flanking members forming the front rails of the armrest are offset relative to one another whereby to provide means to locate the front legs of a further chair stacked thereon.

2. An armchair according to claim 1, wherein selected end portions of said frame members extend downwardly from said armrests to form legs.

3. An armchair comprising a seat, a backrest, and a tubular frame supporting the seat and backrest and forming armrests flanking the seat, wherein the tubular frame member and two flanking frame members respectively, the central frame member having a connecting portion providing a peripheral frame around the top and sides of the backrest and two outer portions in substantially vertical front and rear extending planes, which planes are parallel and adjacent to planes occupied by the flanking members, wherein the tops of the armrests are formed by welded-together parallel and substantially horizontal adjacent portions of said central and flanking frame members, the front of said armrests are formed by downturned continuations of said parallel portions arranged in echelon, and said seat is supported by side rails formed by futher retroverted continuations of at least one of said downturned continuations on each side of the chair, said side rails being supported at their rear ends from downturned rear continuations of the flanking members from the rear of said parallel portions forming the tops of the armrests.

4. An armchair according to claim 3, wherein there are welded connections between the central and flanking frame members at the front and rear of the seat side rails.

5. An armchair according to claim 3 wherein the downturned rear continuations of the flanking members extend to form rear legs of the chair, and wherein one of the downturned frame member portions forming the front of the armrest on each side is not retroverted but instead continued downwards to form a front leg of the chair.

6. An armchair according to claim 3, wherein cross-members are provided which connect the seat side rails and pass beneath and support the seat.

7. An armchair according to claim 6, wherein the cross-members include means by which the chair may be mounted to a base or stand.

8. An armchair comprising a seat, a backrest, a central frame member and two flanking frame members, each frame member being formed by a single continuous length of tubing, wherein the central frame member extends transversely to form a top rail above the backrest, thence downwardly to form side rails supporting the backrest, thence forwardly to form inner parts of the tops of the armrests, thence further downwardly to form inner parts of the fronts of the armrests, and each flanking member has a top portion, which extends parallel to and horizontally abutting one of the forwardly extending portions of the central member and is welded thereto to form the outer part of the top of one of the armrests, together with downturned portions at both ends of the top portions, the front downturned portion forming an outer part of the front of the armrest offset relative to the inner part of the front end of the armrest and the rear downturned portion forming the rear of the armrest, and wherein the frame member portions forming one of the parts of the front of the armrests thereafter extend rearwardly and substantially horizontally to form seat side rails, said seat side rails being welded at front and rear to other portions of the frame members adjacent thereto, cross-members being provided extending between said side rails to support said seat.

* * * * *